US006491344B1

(12) United States Patent
Stumpf et al.

(10) Patent No.: US 6,491,344 B1
(45) Date of Patent: Dec. 10, 2002

(54) CHAIR ADJUSTMENT MECHANISM

(75) Inventors: William S. Stumpf, Waterloo (CA); Ken A. Beggs, Waterloo (CA)

(73) Assignee: Leggett & Platt Ltd., Waterloo (CA)

( * ) Notice: Subject to any disclaimer, the term of this patent is extended or adjusted under 35 U.S.C. 154(b) by 0 days.

(21) Appl. No.: 09/358,096

(22) Filed: Jul. 21, 1999

(51) Int. Cl.[7] ..... A47C 1/025; G05G 5/18
(52) U.S. Cl. ..... 297/374; 297/375; 74/527
(58) Field of Search ..... 297/374, 375; 74/527, 530; 188/67

(56) References Cited

U.S. PATENT DOCUMENTS 4,133,578 A 1/1979 Fancy
4,487,453 A 12/1984 Emmerich et al.
4,898,424 A * 2/1990 Bell ..... 297/375
5,676,425 A * 10/1997 Pernicka ..... 297/374
6,155,644 A * 12/2000 Rogala ..... 297/375 X

* cited by examiner

*Primary Examiner*—Anthony D. Barfield
(74) *Attorney, Agent, or Firm*—Shook, Hardy & Bacon L.L.P.

(57) ABSTRACT

A chair adjustment mechanism is disclosed which allows a change of position in an unlocked state and maintains a position in a locked state. The mechanism, when used in conjunction with an adjustable chair part, may not be unlocked without a force being applied opposite to a force urging the part to a default position.

16 Claims, 5 Drawing Sheets

CHAIR ADJUSTMENT MECHANISM

FIELD OF THE INVENTION

The present invention relates to adjustable chair parts and more particularly to a mechanism to allow a chair part to be adjusted and the adjustment to be maintained.

BACKGROUND OF THE INVENTION

Chairs are known to have parts that are adjustable such as the arm rests, the seat and the backrest. The height of a backrest, for instance, may be adjusted up or down and, additionally, an angle a backrest makes with reference to the seat may be altered. In many chairs, a person seated in a chair who wishes to change the angle of a backrest moves a handle from a locked position to an unlocked position, releasing a mechanism that maintains the support bar for the backrest at a particular angle. The person may then find a new angle for the backrest support bar and, by returning the handle to a locked position, set the mechanism to maintain the new angle.

Typically, springs bias various adjustable parts to a default position. Unfortunately, when a part of an unoccupied chair is unlocked while significantly offset from its default position, a violent action may ensue as the part returns to its default position. This violent action could cause injury. It is desirable, then, to design a mechanism that avoids this problem.

SUMMARY OF THE INVENTION

In accordance with an aspect of the present invention there is provided locking apparatus including a clutch plate and a locking bracket, the locking bracket having a passageway adapted to accept the clutch plate, the passageway including a first channel and a second channel, the first channel allowing movement of the clutch plate along the passageway, the second channel preventing movement of the clutch plate along the passageway.

In accordance with a further aspect of the present invention there is provided a chair including: a chair base; a chair adjustment mechanism, mounted to the chair base, including a locking apparatus comprising a clutch plate and a locking bracket forming a passageway receiving the clutch plate, the passageway including a first channel and a second channel, the first channel allowing movement of the clutch plate along the passageway, the second channel preventing movement of the clutch plate along the passageway; a seat mounted to one of the locking bracket and the clutch plate of the chair adjustment mechanism; a backrest; and a backrest support bar supporting the backrest, mounted to another one of the locking bracket and the clutch plate of the chair adjustment mechanism.

BRIEF DESCRIPTION OF THE DRAWINGS

In the figures which illustrate an example embodiment of this invention.

DETAILED DESCRIPTION OF THE PREFERRED EMBODIMENTS

Figure 1:
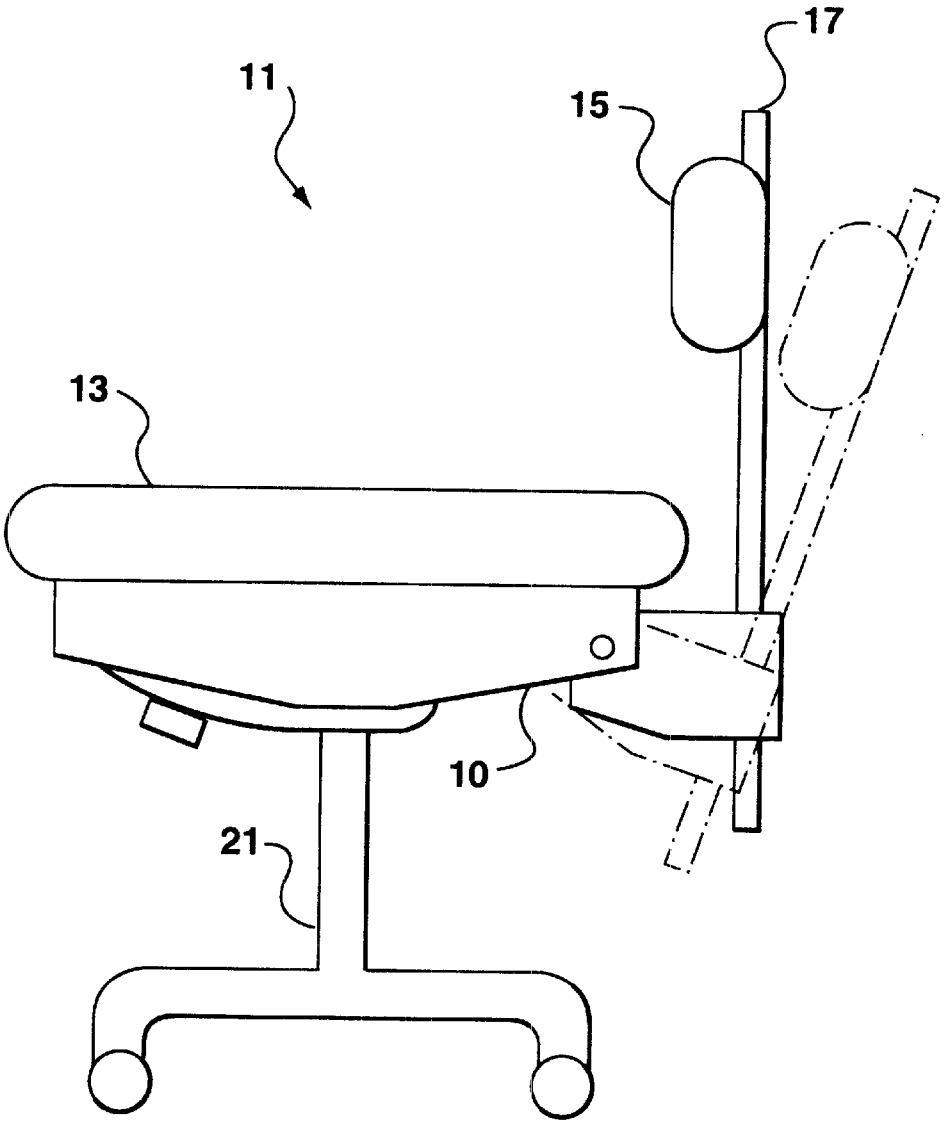
FIG. 1 is a schematic side view of a chair embodying the subject invention.

Referring to FIG. 1, a chair 11 comprises a chair seat 13 and a backrest 15 supported on a backrest support bar 17. The chair seat and backrest support bar are mounted to a chair adjustment mechanism 10 (chair adjustment mechanism 10 is mounted to a chair base 21).

Figure 4:
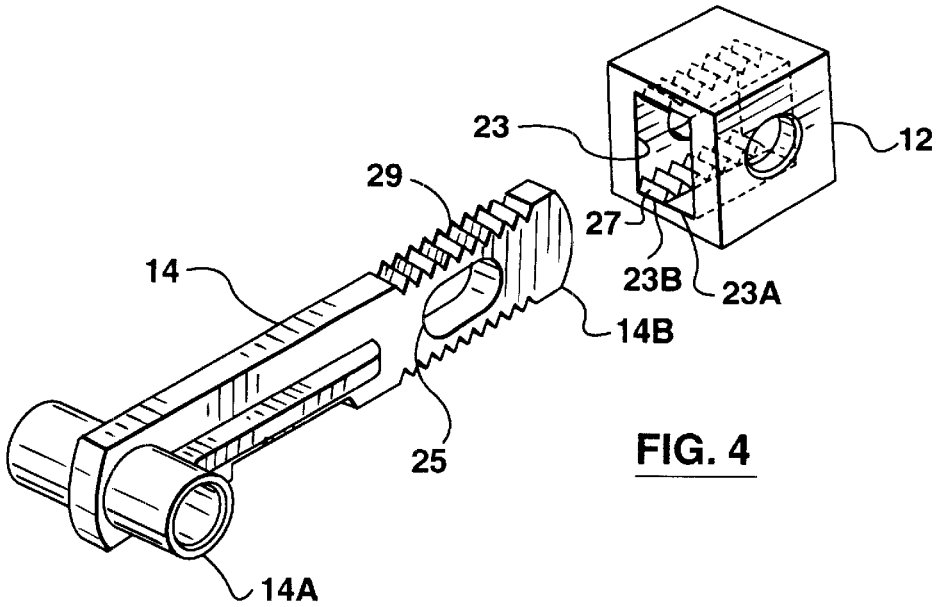
FIG. 4 is an exploded perspective view of a portion of the assembly of FIG. 2.
Figure 2:
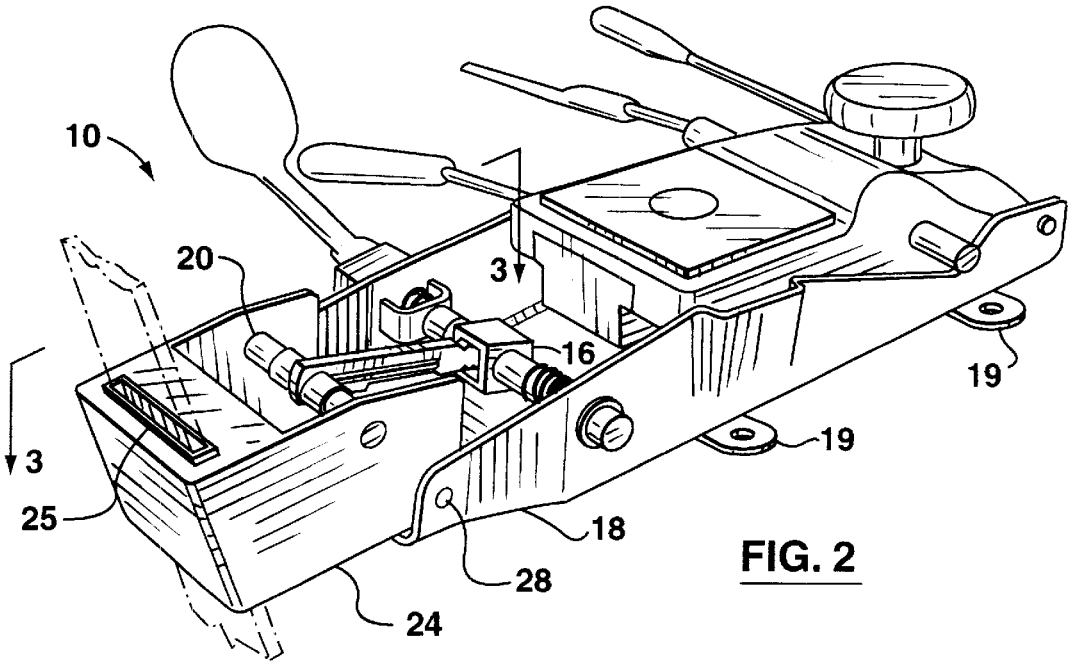
FIG. 2 is a schematic underside perspective view of a chair adjustment assembly made in accordance with the subject invention.
Figure 3:
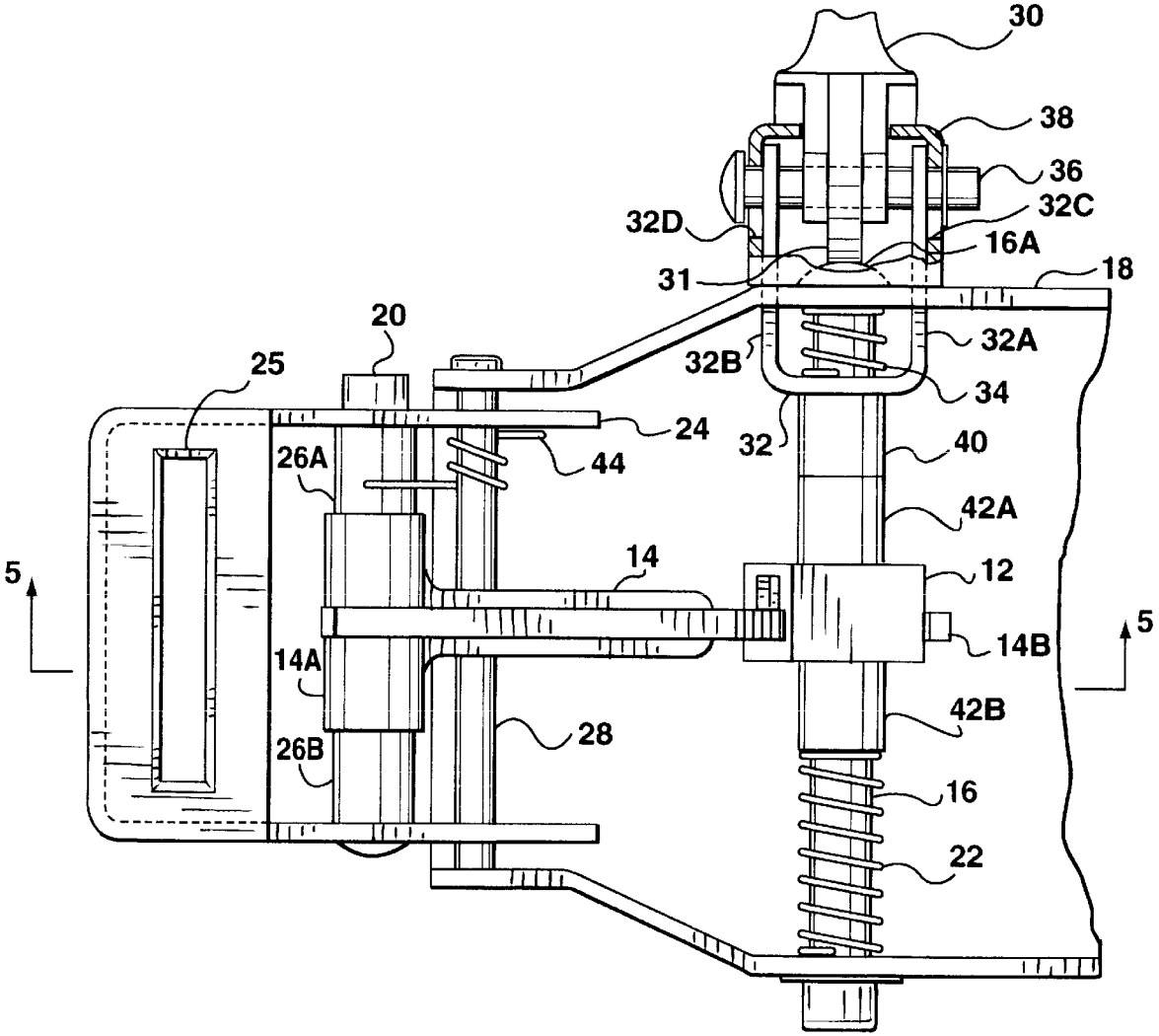
FIG. 3 illustrates a partial underside elevation of the chair adjustment assembly, in an unlocked position, taken along lines 3—3 of FIG. 2.

Referencing FIGS. 2, 3 and 4, chair adjustment mechanism 10 comprises a chair seat frame 18 with seat mounting flanges 19 for accommodating bolts to mount the chair seat to the seat frame 18 and a chair backrest support bracket 24 with a slot 25 for receiving the backrest support bar. The seat frame 18 and backrest support bracket 24 are pivotally joined by shaft 28. Shaft 28 supports a main spring 44 that bears against the underside of the bracket 18 and a shaft 20 carried by the backrest support bracket 24 in order to bias the backrest support bracket to a default angle with respect to the seat frame 18.

The seat frame 18 also carries a shaft 16 on which a locking bracket 12 is slidably mounted. A clutch plate 14 has a tubular end 14A receiving shaft 20 and a slotted end 14B receiving shaft 16. Spacers 26A, 26B on shaft 20 between the sides of the backrest support bracket 24 and tubular end 14A of clutch plate 14 maintain the clutch plate in a fixed position on shaft 20.

A stirrup-shaped compression member 32 has a central opening which receives shaft 16. The arms 32A, 32B of the compression member 32 pass through slots in seat frame 18 and terminate in openings 32C, 32D which receive a pin 36. A handle 30 is pivotally mounted to pin 36 and terminates in a cam 31 which abuts a domed-end abutment 16A of shaft 16. A cam box 38 surrounds the cam 31 and is supported on pin 36.

Referring to FIG. 4, locking bracket 12 has a passageway 23 for receiving clutch plate 14. Passageway 23 has two channels, a first channel 23A in which longitudinal movement of clutch plate 14 is allowed and a second channel 23B in which longitudinal movement of clutch plate 14 is prevented. Prevention of movement in second channel 23B is accomplished by endowing clutch plate 14 with a feature which, as shown, comprise teeth 29 which fit into a corresponding feature in second channel 23B, which, as shown, comprise teeth 27.

Figure 5:
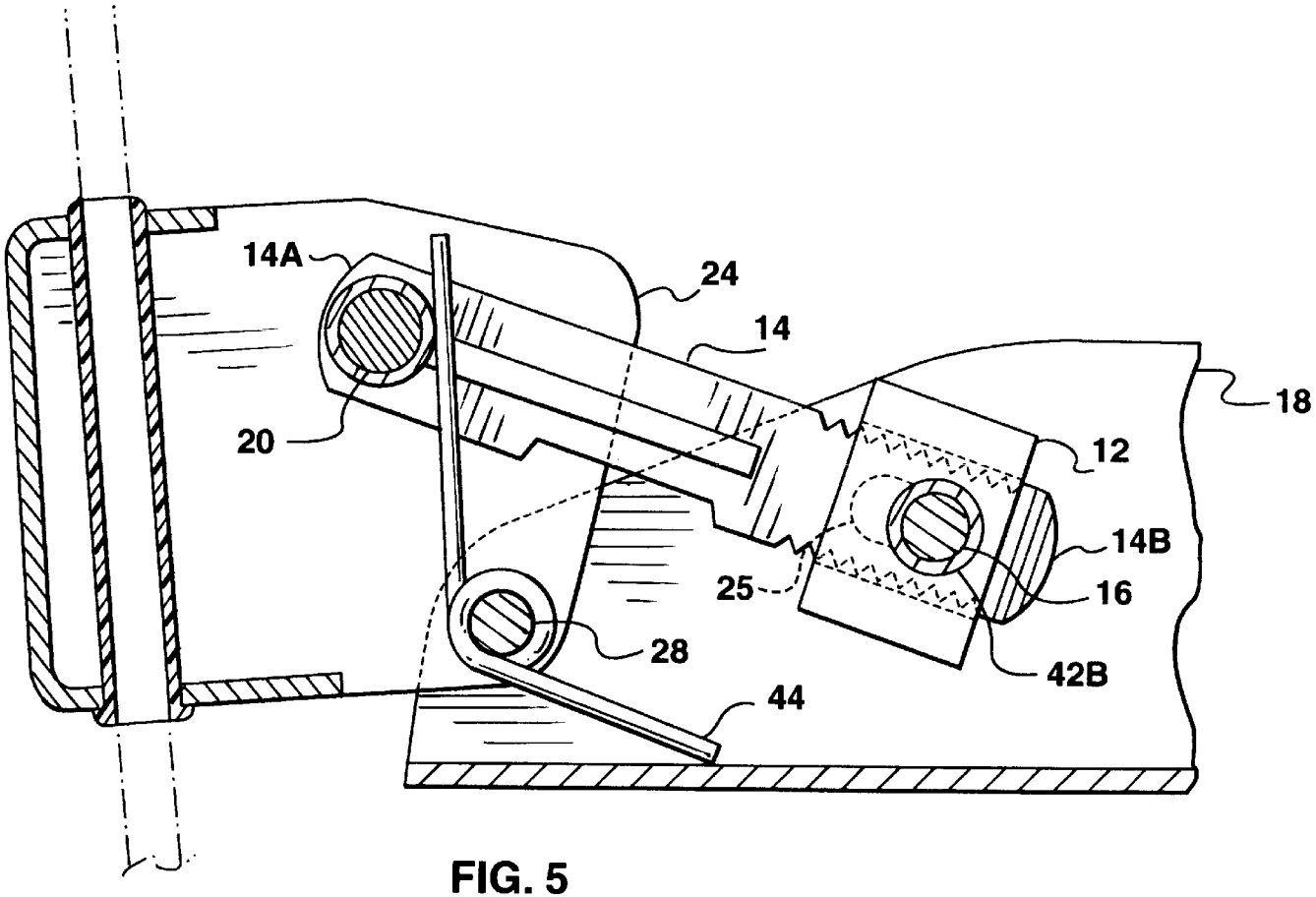
FIG. 5 illustrates a partial section taken along lines 5—5 of FIG. 3.

Returning to FIG. 3, when handle 30 is moved to an "unlocked" position, cam 31 draws compression member 32 outwardly causing the compression member 32 to compress a locking spring 34. Compression of locking spring 34 allows locking bracket 12 to be urged by an unlocking spring 22 acting on spacer 42B toward an "unlocked" position along shaft 16. In the unlocked position, first channel 23A (FIG. 4) of locking bracket 12 receives clutch plate 14 such that clutch plate 14 is free to move within passageway 23 of the locking bracket. With the clutch plate freed to move, as shown in FIG. 5, main spring 44 urges backrest support 24 to tilt with respect to seat frame 18 such that shaft 16 is maintained at an end of slot 25 in clutch plate 14 closest to slotted end 14B.

Figure 6:
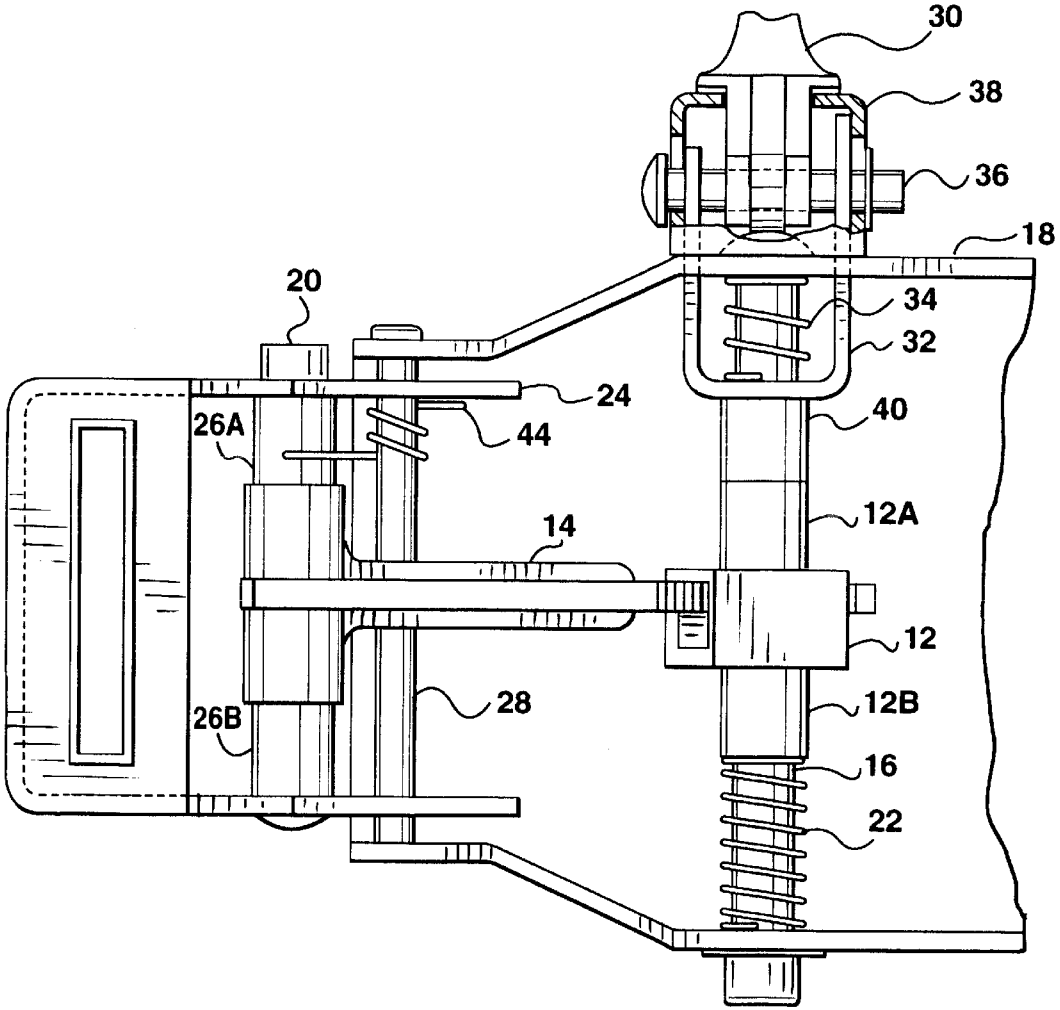
FIG. 6 illustrates a partial underside elevation of a chair adjustment assembly, in a locked position, taken along line 3—3 of FIG. 2.

Locking spring 34, which acts opposite to unlocking spring 22 along shaft 16, is stronger than unlocking spring 22. Consequently, when handle 30 is moved to a "locked" position illustrated in FIG. 6, compression member 32 frees the locking spring 34 to act on spacers 40 and 42A and locking bracket 12 to urge the locking bracket toward a "locked" position along shaft 16. In the locked position, clutch plate 14 is received in second channel 23B (FIG. 4) of locking bracket 12 such that longitudinal movement of the clutch plate through passageway 23 is prevented.

In operation, a user of a chair having chair adjustment assembly 10 may move handle 30 from a locked position to an unlocked position. The resulting action of cam 31 against domed-end abutment 16A of shaft 16 draws compression member 32 outwardly, compressing locking spring 34. Locking bracket 12 is then allowed to be urged by unlocking spring 22 to move from a locked position, which prevents longitudinal movement of clutch plate 14, to an unlocked position, at which movement of clutch plate 14 along passageway 23 of locking bracket 12 is allowed. Despite unlocking spring 34 urging locking bracket 12 along shaft 16 to an unlocked position, locking bracket 12 will not move due to frictional force on locking bracket 12, normal to shaft 16, applied by main spring 44 via shaft 20 and clutch plate 14 unless an opposing force to that of main spring 44 is applied by the user. Thus, once a user leans back on the chair backrest to relieve this frictional engagement of the clutch plate in second channel 23B of locking bracket 12, unlocking spring 34 will move locking bracket 12 along shaft 16 causing clutch plate 14 to move out of second channel 23B and into first channel 23A.

While the clutch plate is in first channel 23A, movement along passageway 23 of locking bracket 12 is allowed and the user of the chair may move the chair backrest to a new position. Once a new position has been decided upon, the user of the chair may move handle 30 from the unlocked position to the locked position. With handle 30 in the locked position, locking spring 34 pushes compression member 32 against spacers 40 and 42A, and consequently locking bracket 12. If teeth 29 of clutch plate 14 and teeth 27 of second channel 23B are aligned, locking bracket 12 moves along shaft 16 so that clutch plate 14 leaves first channel 23A wherein movement is allowed and enters channel 23B wherein teeth 29 of clutch plate 14 and teeth 27 of second channel 23B mesh and movement of clutch plate 14 through passageway 23 is prevented. If teeth 29 of clutch plate 14 and teeth 27 of second channel 23B are not aligned, the locking bracket moves only when the tilt of chair back 17 is varied slightly to align the teeth.

Turning to FIG. 4 in conjunction with FIG. 1, slot 25 defines a range of longitudinal movement of clutch plate 14 through passageway 23 and thus defines a range of possible positions of backrest support bar 17. Due to the clutch plate teeth used to lock backrest support bar 17 in a chosen position, a discrete number of positions, at which backrest support bar 17 may be locked, exist within this range.

In an alternative embodiment, spacers 40, 42A and 42B may be incorporated into the design of compression member 32 or locking bracket 12.

Although springs are used throughout the above disclosure, other resilient members may be used in place of springs, such as resilient clips.

Optionally, a feature other than teeth is used in second channel 23B to prevent movement of clutch plate 14 through passageway 23. Thus, any suitable male feature may be chosen for clutch plate 14 and a corresponding female feature chosen for second channel 23B. For instance, clutch plate 14 could have a series of semicircular protrusions which fit into semicircular indentations in second channel 23B.

In an alternative embodiment, chair adjustment mechanism 10 includes a mechanism for adjusting the angle seat 13 makes with respect to chair base 21. A clutch plate carried by one of a chair seat frame 18 and chair base 21 is received by a locking bracket carried by the other of chair seat frame 18 and chair base 21. A handle is moved to an unlocked position, chair seat 13 is adjusted to a desired angle and the handle is returned to a locked position.

Other modifications will be apparent to those skilled in the art and, therefore, the invention is defined in the claims.

What is claimed is:

1. A locking apparatus comprising a clutch plate and a locking bracket, said locking bracket having a passageway adapted to accept said clutch plate, said passageway including a first channel and a second channel, said first channel allowing movement, of said clutch plate along said passageway, said second channel having a featured channel wall for interacting with features of said clutch plate to prevent movement of said clutch plate along said passageway further comprising a frame and a first shaft extending inwardly from a side of said frame, wherein said clutch plate has a slot for receiving said first shaft and said locking bracket is mounted on said shaft.

2. The locking apparatus of claim 1 further comprising a resilient locking member biasing said locking bracket along said first shaft to maintain said clutch plate in said second channel.

3. The locking apparatus of claim 1 further comprising an resilient unlocking member, weaker than said resilient locking member, biasing said locking bracket along said first shaft to maintain said clutch plate in said first channel.

4. The locking apparatus of claim 3 further comprising a compression member between said locking bracket and said resilient locking member, said compression member moveable to a first position whereat said compression member compresses said resilient locking member against said frame such that said resilient unlocking member is free to bias said locking bracket along said first shaft to maintain said clutch plate in said first channel.

5. The locking apparatus of claim 4 wherein said compression member has a bore therethrough, said bore receiving said first shaft.

6. The locking apparatus of claim 4 wherein said compression member is moveable to a second position in which said resilient locking member biases said locking bracket along said first shaft to maintain said clutch plate in said second channel.

7. The locking apparatus of claim 2 wherein one of said second channel wall and said clutch plate has a plurality of male features and another one of said second channel wall and said clutch plate has a plurality of female features.

8. The locking apparatus of claim 7 wherein said features are teeth.

9. A locking apparatus comprising:

a clutch plate and a locking bracket, said locking bracket having a passageway adapted to accept said clutch plate, said passageway including a first channel and a second channel, said first channel allowing movement of said clutch plate along said passageway, said second channel having a featured channel wall for interacting with features of said clutch plate to prevent movement of said clutch plate along said passageway, said locking bracket moveable with respect to said clutch plate so that said clutch plate moves out of said first channel and into said second channel;

a resilient locking member biasing said locking bracket to maintain said clutch plate in said second channel; and a resilient unlocking member, weaker than said resilient locking member, biasing said locking bracket to maintain said clutch plate in said first channel.

10. The locking apparatus of claim 9 further comprising a compression member between said locking bracket and said resilient locking member, said compression member moveable to a first position whereat said compression member compresses said resilient locking member such that said resilient unlocking member is free to bias said locking bracket to maintain said clutch plate in said first channel.

11. The locking apparatus of claim 10 wherein said compression member is moveable to a second position in which said resilient locking member biases said locking bracket to maintain said clutch plate in said second channel.

12. A locking apparatus comprising a toothed clutch plate and a locking bracket, said locking bracket having a walled passageway adapted to accept said clutch plate, one wall of said passageway having, in side-by-side relation, a toothed portion and a non-toothed portion, said locking bracket moveable relative to said clutch plate such that said clutch plate may be located at said non-toothed portion of said one wall of said passageway whereat said clutch plate may slide along said passageway and such that said clutch plate may be located at said toothed portion of said one wall of said passageway whereat said clutch plate is prevented from sliding along said passageway.

13. The locking apparatus of claim 12 further comprising a resilient locking member biasing said locking bracket to maintain said clutch plate at said toothed portion.

14. The locking apparatus of claim 13 further comprising an resilient unlocking member, weaker than said resilient locking member, biasing said locking bracket to maintain said clutch plate in said non-toothed portion.

15. The locking apparatus of claim 14 further comprising a compression member between said locking bracket and said resilient locking member, said compression member moveable to a first position whereat said compression member compresses said resilient locking member such that said resilient unlocking member is free to bias said locking bracket to maintain said clutch plate in said non-toothed portion.

16. The locking apparatus of claim 15 wherein said compression member is moveable to a second position in which said resilient locking member biases said locking bracket to maintain said clutch plate in said second channel.

* * * * *